US006279794B1

(12) United States Patent
Miyazaki

(10) Patent No.: US 6,279,794 B1
(45) Date of Patent: Aug. 28, 2001

(54) PACKAGING BOTTLE WITH CARRYING HANDLE

(75) Inventor: Motoaki Miyazaki, Tokyo (JP)

(73) Assignee: Vijay Co., Ltd., Tokyo (JP)

( * ) Notice: Subject to any disclaimer, the term of this patent is extended or adjusted under 35 U.S.C. 154(b) by 0 days.

(21) Appl. No.: 09/355,261

(22) PCT Filed: Feb. 19, 1999

(86) PCT No.: PCT/JP99/00754

§ 371 Date: Jul. 26, 1999

§ 102(e) Date: Jul. 26, 1999

(87) PCT Pub. No.: WO99/42378

PCT Pub. Date: Aug. 26, 1999

(30) Foreign Application Priority Data

Jul. 13, 1998 (JP) ..... 10-5163 U
Sep. 2, 1998 (JP) ..... 10-742 U

(51) Int. Cl.[7] ..... A45F 5/00; A45F 3/16

(52) U.S. Cl. ..... 224/148.7; 224/148.4; 224/148.6; 224/250; 224/248; D3/229

(58) Field of Search ..... 224/148.7, 247, 224/248, 249, 148.5, 148.6, 250, 148.1, 148.4; 294/31.1; 248/311.2; 220/758; D3/229

(56) References Cited

U.S. PATENT DOCUMENTS

| | | | | |
|---|---|---|---|---|
| D. 423,774 | * | 5/2000 | Peterson | D32/229 |
| 1,022,791 | * | 4/1912 | Laird, Jr. | 224/229 |
| 1,214,161 | * | 1/1917 | Hettinger et al. | 224/247 |
| 1,605,195 | * | 11/1926 | Lewis | 224/148.6 |
| 1,825,897 | * | 10/1931 | Brooke | 294/31.2 |
| 2,222,914 | * | 11/1940 | Pires | 210/239 |
| 4,955,572 | * | 9/1990 | Simmons | 224/148.4 X |
| 5,214,825 | * | 6/1993 | Hirzel | 24/67.9 |
| 5,325,991 | * | 7/1994 | Williams | 220/739 |
| 5,489,078 | * | 2/1996 | Risley | 248/231.91 |
| 5,622,346 | * | 4/1997 | Story, Jr. | 248/311.2 |
| 6,019,335 | * | 2/2000 | Schati | 224/148.4 X |
| 6,131,779 | * | 10/2000 | Gendala | 224/148 X |

FOREIGN PATENT DOCUMENTS

| | | |
|---|---|---|
| 49-24876 | 3/1974 | (JP) . |
| 52-68893 | 5/1977 | (JP) . |
| 54-85161 | 6/1979 | (JP) . |
| 60-38229 | 3/1985 | (JP) . |
| 60-179631 | 11/1985 | (JP) . |
| 61-207230 | 12/1986 | (JP) . |
| 7-17544 | 1/1995 | (JP) . |

* cited by examiner

*Primary Examiner*—Gregory M. Vidovich
(74) *Attorney, Agent, or Firm*—Jiawei Huang; J.C. Patents

(57) ABSTRACT

A plastic container bottle provided with carrying means. The bottle is composed of a neck portion of thick wall that has a step below a support ring formed around a lower portion of the neck portion and projecting therefrom and a ring-shaped groove between the step and the support ring, and a flat-shaped body portion of thin wall with shoulder portions extending to both sides from the base of the neck portion, that are formed integrally by stretch blow molding process. The carrying means is composed of a rectangular insertion plate having a width at least substantially the same as the outer diameter of the neck portion and a fitting portion at an end thereof that are integrally formed from a flexible thermoplastic material in an L-shape, the fitting portion having a pair of holding pieces of the same shapes with inner circumference thereof having the same diameter as the diameter of the ring-shaped groove and end opening being narrower than the diameter of the ring-shaped groove. The holding pieces are fitted onto the ring-shaped groove from the back face side of the body portion of the bottle, and the insertion plate is located with the longitudinal direction directed vertically at the center of the back face of the body portion, with a holding space being formed between the insertion plate and the back face side of the body portion.

12 Claims, 5 Drawing Sheets

PACKAGING BOTTLE WITH CARRYING HANDLE

TECHNICAL FIELD

The present invention relates to a container bottle provided with carrying means, and more particularly to a container bottle provided with carrying means, main body of the container bottle being a thin-walled plastic bottle made by stretch blow molding process, to be used for containing a beverage or a non-beverage liquid such as body lotion, and that can be attached to a human body and carried.

BACKGROUND ART

A container bottle, being generally called the PET bottle and widely used for containing a beverage, is made of a thermoplastic resin such as polyethylene terephthalate (PET) that is stretched in two directions (biaxial stretching), namely longitudinal and transverse directions, in stretch blow molding process to have thin walls in a body portion and bottom portion except for a neck portion.

Most of the PET bottles have been developed for the purpose of containing drinking water, beverages such as juice and sports drink, edible oil, seasoning liquid or the like, with the place of use thereof being limited to indoors. Therefore capacity thereof has been mostly 1 liter or greater. As a consequence, there has been no need to give consideration to carrying along of the bottles.

However, as a small bottle of capacity of 500 ml or less for containing drinks to be used on tables are being produced, applications of the bottles have been expanding for containing non-beverage liquids such as body lotion and sun-oil with the trend of the decreasing size of the bottles. Particularly the PET bottle, because of its light weight and high impact strength, is used by some people for the purpose of drinking outdoors by carrying the container bottle like a canteen.

Carrying the PET bottle outdoors so far has been limited to such forms as winding a cord around a portion below a support ring of the neck portion that has a thread being formed on the circumference thereof for securing a cap, and passing the cord across the carrying person's neck on the back thereof so that the bottle hangs in front of the person's chest, or the cord is put around a belt so that the bottle hangs around the hip.

When the bottle is carried in such a manner as described above, since an ordinary container bottle having a round body portion is just suspended on a cord, the bottle is unstable and sways as the person carrying the bottle walks, and the appearance is not good to look at. Thus it has been a very limited number of people who carry the bottles with cords.

Therefore, an object of the present invention is to provide a container bottle body portion of which is formed in a flat configuration for the convenience of carrying, which is provided with carrying means attached to the body portion of the bottle over a back face thereof or from the front face to the back face thereof, which can be used in a carefree manner by many people with stability of the bottle being maintained during physical exercise as well walking simply attaching the container bottle to a belt of the person by means of the carrying means, and the appearance of which is good to look at.

Another object of the present invention is to provide a container bottle provided with carrying means that is not bulky when put in a bag, a shoulder bag or the like together with the carrying means attached thereto, and can be used for containing liquids such as body lotion and sun-oil, as well as beverages.

DISCLOSURE OF THE INVENTION

The present invention comprises; a container bottle made of a plastic by integrally forming a neck portion of thick wall that has a step below a support ring of thick wall formed around a lower portion of the neck portion and projecting therefrom and a ring-shaped groove between the step and the support ring, and a flat body portion of thin wall with a shoulder portion extending to both sides from the base of the neck portion, by stretch blow molding process; and carrying means comprising a rectangular insertion plate having a width at least substantially the same as the outer diameter of the neck portion of the bottle and a fitting portion that is integrally formed at an end of the insertion plate from a flexible thermoplastic material in an L-shape, the fitting portion having a pair of holding pieces of the same shapes with inner circumference thereof having the same diameter as the diameter of the ring-shaped groove and end opening being narrower than the diameter of the ring-shaped groove. The holding pieces are fitted onto the ring-shaped groove from the back face side of the body portion of the bottle, and the insertion plate is provided with the longitudinal direction directed vertically at the center of the back face of the body portion, so that a holding space is formed between the insertion plate and the back face side of the body portion.

The bottle is composed of a flat rectangular parallelepiped that is somewhat elongated in the longitudinal direction with the shoulder portion extending from the base of the neck portion to both sides in a substantially rectangular shape, with the surfaces on both sides warped in the same direction, a convex side being used as front face of the body portion and a concave side used as a back face of the body portion, while a plurality of reinforcing ribs are provided recessedly in an endless manner at equal intervals vertically around a lower portion of the bottle.

The carrying means has bends that are bent at upper and lower positions where the bends extend to the insertion plate and the fitting portion, while the insertion plate is slanted inward from the lower bend downward with an elongated aperture made therein so that the insertion plate has an elastic force.

The insertion plate is bent at a lower position so that a free end thereof is directed outward and a bending portion is pressed against the back face of the body portion to make a strong contact therewith, while a reaction force thereto is concentrated at tips of the pair of holding pieces that form the fitting portion, thereby causing a rear end of the fitting portion to make strong contact with the bottom face of the support ring.

The pair of holding pieces are formed to have an opening with width at the end thereof being smaller than the diameter of the ring-shaped groove, so that the holding pieces fit into the ring-shaped groove and hold onto the wall thereof when being forced therein, or projections are formed to oppose each other on inner edges of the end opening that is formed to have the same width as the diameter of the ring-shaped groove so that the holding pieces fit into the ring-shaped groove and hold onto the wall thereof. Alternatively, projections may also be formed in a configuration like ratchet teeth with inclined surfaces facing toward the opening, so that the projections fit in recesses formed on both sides at the center of the ring-shaped groove in corresponding shapes to oppose each other, with inclined surfaces facing the front face of the body portion.

The carrying means comprises the fitting portion formed at the top end of a support plate, that makes contact with the back face of the body portion, being bent therefrom, and a bottle bottom receiving portion formed at the lower end thereof being bent in the same direction as the fitting portion, wherein an L-shaped insertion plate or a C-shaped belt passage plate is provided at an upper position of the support plate.

Alternatively, the carrying means comprises a strap having such a length that substantially make one turn around the bottle vertically at a position offset from the neck portion, connectors attached at both ends of the strap, a belt holding portion provided at a middle portion of the strap, a bottle shoulder holding portion provided between one of the connectors and the belt attaching portion and a bottom receiving portion provided between the other connector and the belt attaching portion, wherein the neck portion of the bottle is passed through an insertion hole formed in the bottle shoulder holding portion with the belt holding portion being located on the back side of the body portion, while the bottle shoulder holding portion is placed across the shoulder portion of the bottle, and the bottle bottom receiving portion makes contact with a bottom portion of the bottle with the strap being connected endlessly by the connectors located at the front face of the body portion to hold onto the bottle vertically.

The strap is made of a fabric belt, a leather belt, a plastic belt or the like, and the connector is a plastic buckle or a surface fastener.

BEST MODE FOR CARRYING OUT THE INVENTION

Now the present invention will be described in more detail below with reference to the accompanying drawings.

Figure 1:
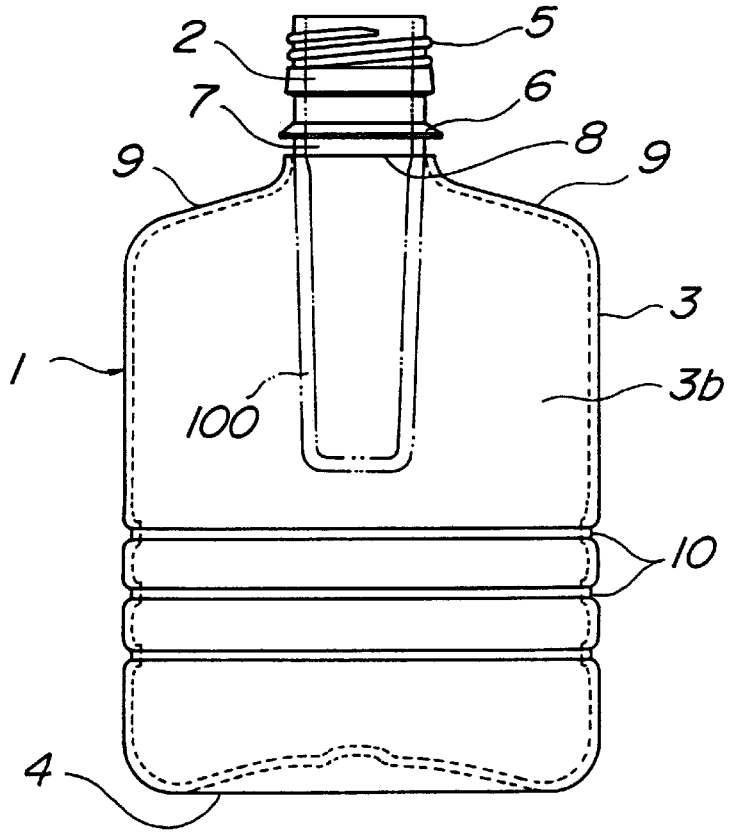
FIG. 1 is a front view of a container bottle that can be employed for the present invention.
Figure 2:
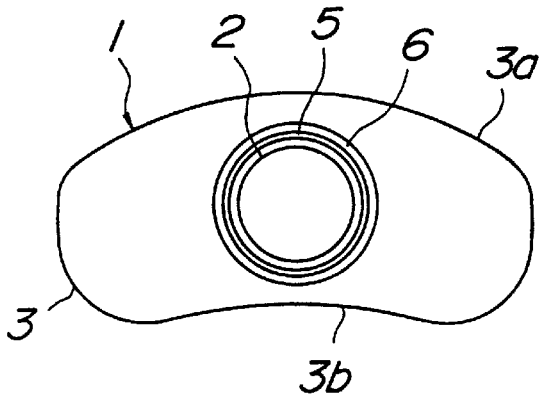
FIG. 2 is a plan view of the above.
Figure 3:
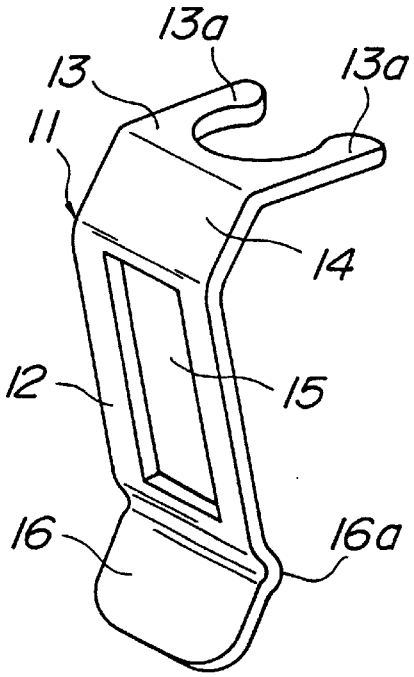
FIG. 3 is a perspective view of a carrying means.

FIG. 1 and FIG. 2 show a flat-shaped container bottle 1 having a capacity of about 500 ml. The bottle 1 is made from a preform 100 formed by ordinary injection molding of polyethylene terephthalate, that is then vertically stretched in the body portion and the lower portion of the bottle by mechanical means while holding a neck portion 2 by means of a blow mold (not shown), and is also expanded to stretch in a radial direction by air blow, thereby forming the body portion 3 and the bottom portion 4 with smaller wall thickness (from about 0.4 to about 0.6 mm) than the wall thickness of the neck portion 2 (about 1.5 mm).

The neck portion 2 has a cap thread 5 formed integrally therewith on the circumference in the upper portion thereof when forming the preform, a support ring 6 formed to project at a lower position and a ring-shaped groove 7 formed between the support ring and a step 8 formed below. The diameter of the ring-shaped groove 7 is made equal to the outer diameter of the neck portion 2.

The body portion 3 is composed of a somewhat elongated flat rectangular parallelepiped with a shoulder portion 9 extending from the base of the neck portion 2 on either side in a substantially rectangular shape. The surfaces on both sides of the body portion are warped in the same direction, in which a convex side is used as a front face 3*a* of the body portion and a concave side is used as a back face 3*b* of the body portion, while a plurality of reinforcing ribs 10 are provided recessedly in an endless manner at equal intervals in the vertical direction around a lower portion.

Reference numeral 11 denotes carrying means comprising at least a rectangular insertion plate 12 having a width substantially the same as the outer diameter of the neck portion 2 and a fitting portion 13 provided at one end thereof, that are formed integrally in an L-shaped single piece from a thermoplastic material that has flexibility such as polyethylene.

The fitting portion 13 is composed of a pair of holding pieces 13*a*, 13*a* of the same shapes that are formed to have inner circumference of the same diameter as the diameter of the ring-shaped groove 7 and an end opening narrower than the diameter of the ring-shaped groove 7. A bend portion between the insertion plate 12 and the fitting portion 13 is formed to have an inclined surface 14 with bends at upper and lower positions, while the insertion plate 12 is slanted inward and downward from the lower bend with an elongated aperture 15 made therein so that the insertion plate has an elastic force. The insertion plate 12 is also bent at a lower position so that a free end 16 thereof is directed outward to make it easier to insert inside a belt 17 or the like, as shown in FIG. 4 and FIG. 5.

Since the carrying means 11 is made of a thermoplastic material, when the fitting portion 13 is forced onto the bottle neck from the back face side of the bottle, the holding pieces 13*a* deflect outwardly to widen the opening thereof even when the end opening of the pair of holding pieces 13*a*, 13*a* is made smaller than the diameter of the ring-shaped groove 7, and the holding pieces restore the former positions after being fitted, and therefore the fitting portion can be easily fitted between the support ring 6 and the step 8 of the neck portion 2.

Figure 4:
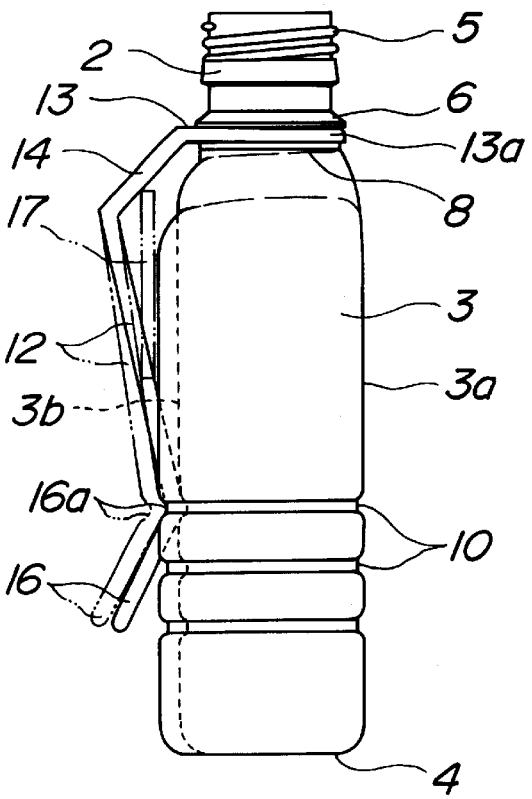
FIG. 4 is a side view of a bottle with the carrying means attached thereto.
Figure 5:
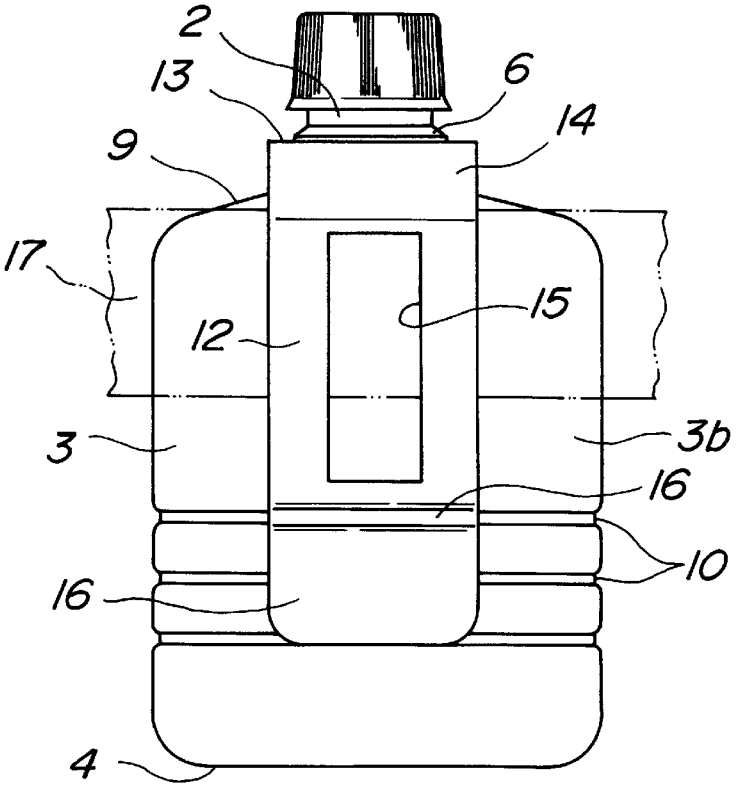
FIG. 5 is a rear view of the above.

Also as shown in FIG. 4 and FIG. 5, the insertion plate 12 is fitted to be located longitudinally at the center of the back face 3*b* of the body portion that has a concave surface, and a holding space for the belt 17 or the like is formed between the insertion plate and the back face 3*b* of the body portion. Further, the bending portion 16*a* of the free end 16 that is located at the lower end of the insertion plate 12 is pressed against the back face 3*b* of the body portion to make a strong contact therewith, while a reaction force thereto is concentrated at tips of the pair of holding pieces 13*a*, 13*a*, thereby causing the rear end of the fitting portion 13 to be pressed upward.

As a consequence, while being omitted in the drawings, the fitting portion 13 is positioned obliquely in the ring-shaped groove, making strong contact with the upper face of the step 8 at the tip thereof and with the lower face of the support ring 6 at the rear end thereof. As a result, even when the fitting portion 13 is formed to have a wall thickness smaller than the groove width thus causing a clearance therebetween, the carrying means 11 is firmly attached to the bottle 1 without looseness, thus preventing play due to vibration.

Consequently, the bottle 1 can be worn simply by inserting the insertion plate 12 inside the belt 17 of trousers, and can be removed together with the carrying means 11 from the belt 17 easily by simply pulling upward.

Figure 6A:
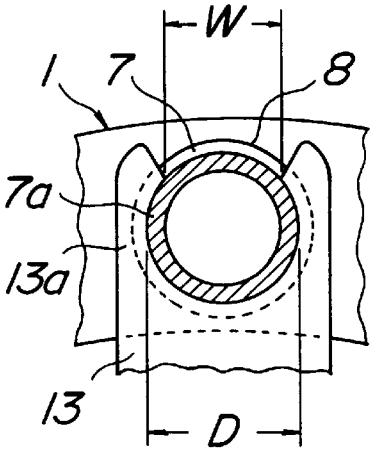
FIG. 6(*a*), FIG. 6(*b*) and FIG. 6(*c*) are partial plan views showing cross section of a neck portion of the bottle with the carrying means being mounted thereon in different manners.
Figure 6B:
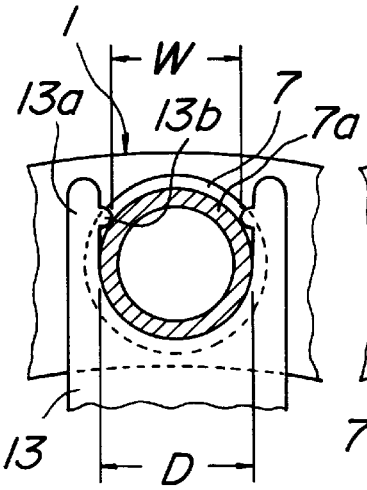
Figure 6C:
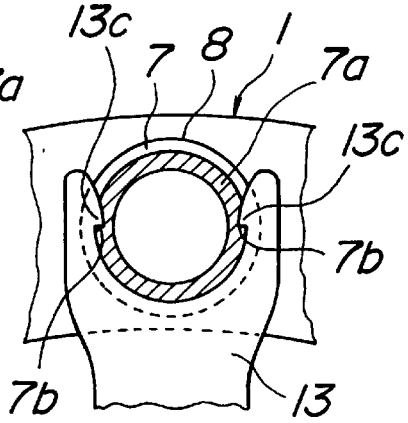

FIG. 6(*a*) through FIG. 6(*c*) show examples of fitting the pair of holding pieces 13*a*, 13*a* in the ring-shaped groove 7. FIG. 6(*a*) shows a case where a ring-shaped groove wall 7*a* is held by forming the opening width W of the holding pieces 13*a*, 13*a* smaller than the diameter D of the ring-shaped groove 7. FIG. 6(*b*) shows a case where the ring-shaped groove wall 7*a* is held by the holding pieces 13*a*, 13*a* with the opening width W being formed equal to the diameter D of the ring-shaped groove 7 and projections 13*b* formed on the inner edges of the opening to oppose each other. FIG. 6(*c*) shows a case where the holding pieces 13*a*, 13*a* are formed in an arc shape with projections 13*c*of ratchet teeth configuration provided on the inner edges of the opening to project therefrom with inclined surfaces directed toward the opening, while recesses 7*b* that correspond to the projections 13*c* are formed on both sides at the center of the ring-shaped groove wall 7*a* to oppose each other, with inclined surfaces facing the front face 3*a* of the body portion being, so that fitting is made more firmly due to the engagement of the recess 7*b* and the projections 13*c*, respectively.

In the case of fitting by means of the recesses 7*b* and the projections 13*c*, while engagement is easily made by pressing due to the inclined surface on the opening side, it is less likely to disengage in the pulling direction due to the step and therefore the bottle 1 does not come off the carrying means 11 even when the bottle is attached to the belt 17 and carried during violent sport activities such as skiing or cycling.

Moreover, since the carrying means 11 can be easily attached to and detached from the bottle 1, the carrying means 11 may be attached to the bottle 1 and used only when it is necessary, and because the carrying means 11 is attached later, the support ring 6 that is required to fill the bottle with content does not lose the function thereof.

Figure 7:
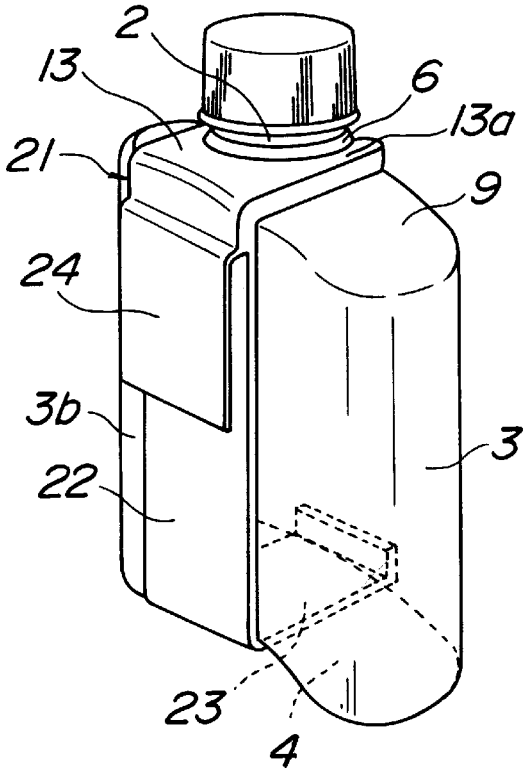
FIG. 7 and FIG. 8 are perspective views showing embodiments where carrying means are fitted to both the neck portion and the bottom portion of the bottle.
Figure 8:
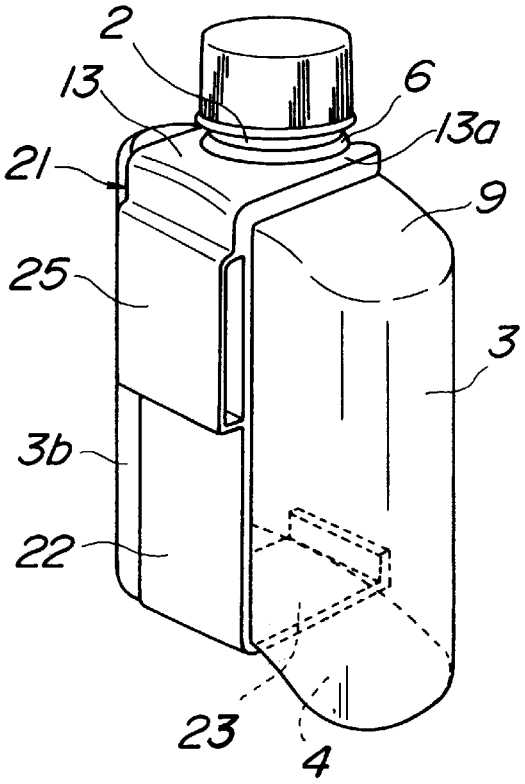
Figure 9:
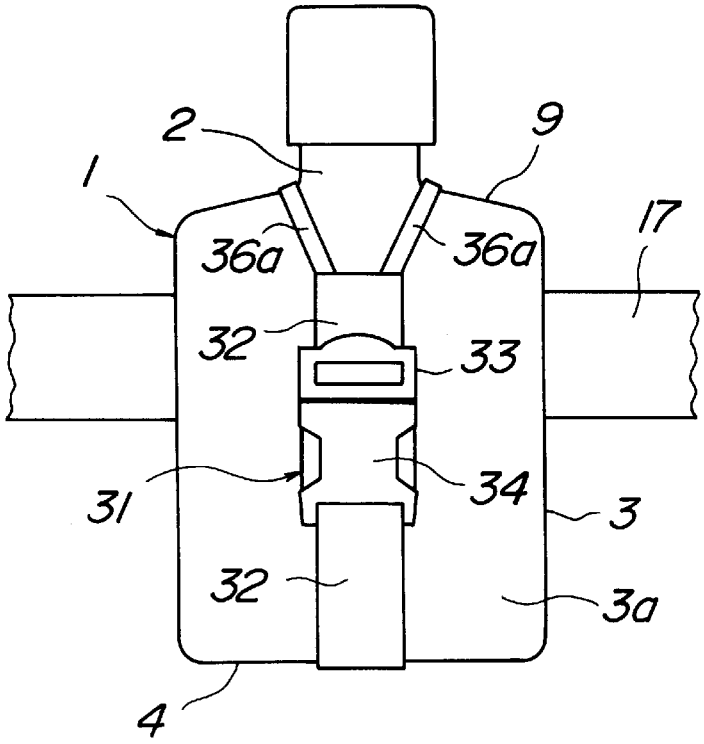
FIG.9 is a front view of a bottle in another embodiment of the present invention provided with belt-shaped carrying means.
Figure 10:
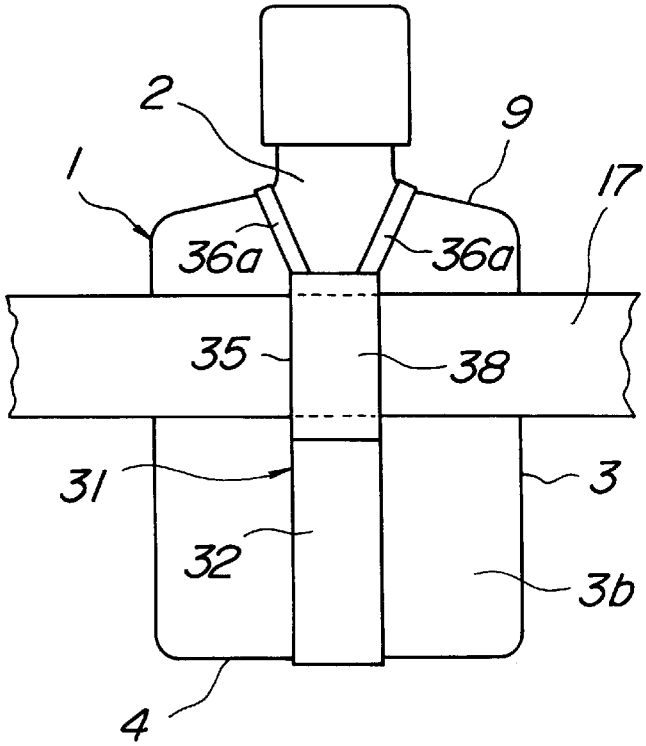
FIG. 10 is a rear view of the above.

In the embodiments shown in FIG. 7 and FIG. 8, the bottle 1 has carrying means 21 with a support plate 22 formed by continuously bending on the fitting portion 13 instead of the insertion plate 12.

The support plate 22 has a bottom receiving portion 23 for the bottle 1 that is formed by bending the lowest portion of the support plate in the same direction as the fitting portion 13. In the embodiment shown in FIG. 7, an L-shaped insertion plate 24 directed downward is provided in the upper portion of the support plate 22. In the embodiment shown in FIG. 8, a belt passage plate 25 formed in a C shape is provided in the upper portion with the opening facing inward. These carrying means 21 have such an advantage that the bottle 1 can be attached in stable condition since the bottom receiving portion 23 supports the bottle 1 on the bottom portion 4 thereof.

Figure 11:
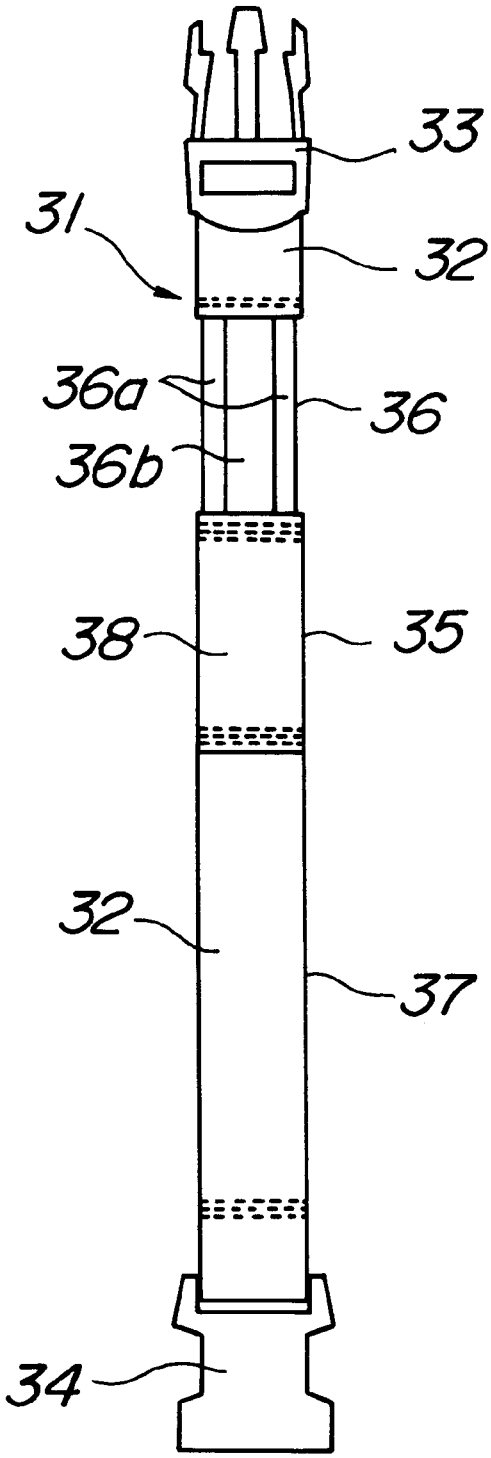
FIG. 11 is a front view of the belt-shaped carrying means described above being extended.
Figure 12:
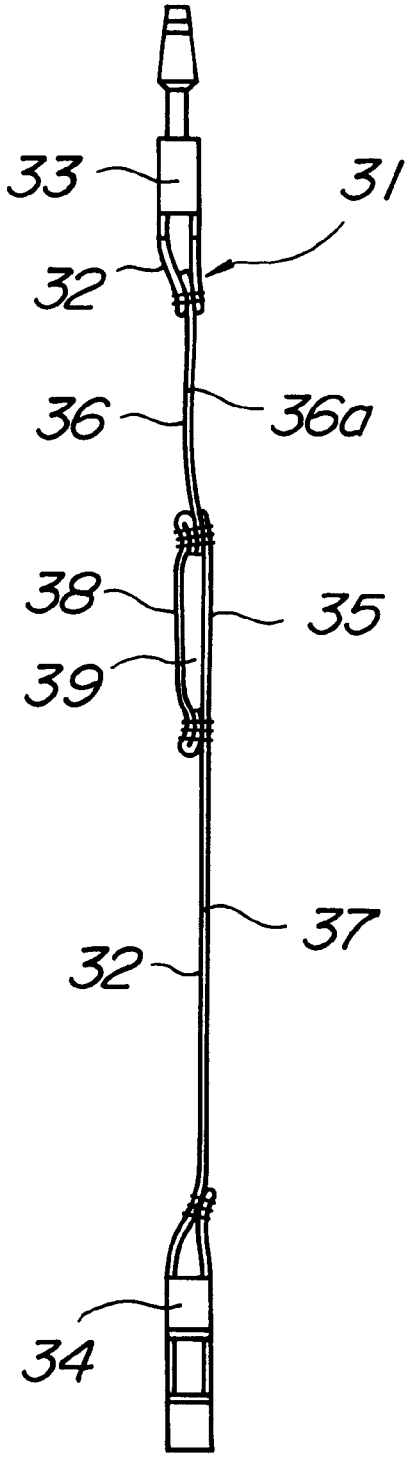
FIG. 12 is a side view of the above.

FIG. 9 through FIG. 12 show embodiments of the bottle 1 provided with belt-shaped carrying means 31. The carrying means 31 is composed mainly of a strap 32 having such a length that makes substantially one turn around the bottle 1 vertically at a position offset from the neck portion 2. The strap 32 has connectors 33, 34 attached at both ends thereof as shown in FIG. 11 and FIG. 12, and a belt holding portion 35 provided at a middle portion of the strap. The strap 32 also has a bottle shoulder holding portion 36 provided between one connector 33 and the belt holding portion 35, while a bottom receiving portion 37 is provided between the other connector 34 and the belt holding portion 35.

The strap 2 can be made of a fabric belt, leather belt, plastic belt or the like that is thick and tough. The connectors 33, 34 may be plastic buckles such as used for connecting bands of rucksack, bag or the like.

The connectors 33, 34 are attached to the strap 32 by turning down and sewing the ends of the strap 32. One of the connectors, for example 34, may also be attached in such a manner as the length of the strap 32 can be adjusted. For the connector, a surface fastener or the like may also be employed.

The belt holding portion 35 is formed by sewing the ends of a short strap piece 38 of the same material as the strap 32. This results in a hole 39 for passing the belt 17, formed between the strap piece 38 and the strap 32.

The bottle shoulder holding portion 36 is formed by connecting a middle portion of the strap 32 with two pieces of cord 36*a* (may also be a rope or the like). A space 36*b* for inserting the neck portion 2 of the bottle 1 is formed between the two cords 36*a*. The bottle shoulder holding portion 36 may also be formed by making a neck insertion hole in the middle portion of the strap 32 that is a continuous piece.

The carrying means 31 as described above eliminates the need for the ring-shaped groove 7 of the neck portion 2. That is, when the bottle 1 is carried, the neck portion 2 of the bottle 1 is inserted between the two cords 36*a* while the belt holding portion 35 is positioned at the back face 3*b* of the body portion. Next, the two cords 36*a* are put on the bottle shoulder portions 9 of both sides of the neck portion 2 from the front to the back side, while the bottom receiving portion 37 is put onto the bottom portion 4 of the bottle 1, and the other end of the strap 32 is pulled over to the front face 3a side of the body portion to lock the connectors 33, 34 to each other. Thus the bottle 1 can be securely held on a hip by passing the belt 17 through a hole 39 of the belt holding portion 35 sideways during carrying it.

The bottle 1 can be easily removed from the carrying means 31 by unlocking the connectors 33, 34, and therefore it is easy to d rink the beverage contained in the bottle 1. In order to make it easier to attach the bottle 1 to the carrying means 31 and to detach therefrom, it is preferable to place the connectors 33, 34 on the front face 3*a* side of the body portion where the surface is convex.

While the belt holding portion 35 is formed by sewing the both ends of the strap piece 38 onto the strap 32 in this embodiment, the bottle holding portion 35 may have other configuration. For example, while omitted in the drawing, the belt holding portion 35 may have such a configuration as a hook made of a metal or a hard plastic is sewed onto the strap and the hook is engaged with the belt.

INDUSTRIAL APPLICABILITY

As will be apparent from the foregoing description, the container bottle provided with the carrying means according to the present invention can be carried by using a belt of trousers, the bottle being filled with a beverage or a non-beverage liquid. As a result, small container bottles of which use has so far been limited to the use on the table can be used outdoors by carrying the bottle along during jogging, cycling, hiking and other activities. Also as the bottle is formed in a flat configuration and the warped surface of the bottle fits around a hip of a person, attaching the bottle to a human body does not cause uncomfortable, bulky feeling. The bottle itself can be easily formed by the conventional process of stretch blow molding with no trouble during to filing of the bottle with a content, and therefore the bottle can be used for wide applications as a container bottle that can be carried along.

What is claimed is:

1. A container bottle comprising:

a plastic container bottle composed of a neck portion of thick wall, said neck portion having a step below a support ring of thick wall formed around a lower portion of said neck portion and projecting therefrom and having a ring-shaped groove between the step and the support ring, and a flat-shaped body portion of thin wall with shoulder portions extending to both sides from the base of the neck portion, that is formed integrally by stretch blow molding process; and carrying means composed of a rectangular insertion plate having a width at least substantially the same as the outer diameter of said neck portion, but smaller than a width of the body portion, and a fitting portion at an end thereof that is integrally formed from a flexible thermoplastic material in an L-shape, the fitting portion having a pair of holding pieces of the same shape with inner circumference thereof having the same diameter as the diameter of the ring-shaped groove and an end opening being narrower than the diameter of the ring-shaped groove, wherein said holding pieces are fitted onto the ring-shaped groove from the back face side of the body portion of the bottle, and said insertion plate is located with the longitudinal direction directed vertically at the center of the back face of the body portion, while a holding space is formed between said insertion plate and the back face side of the body portion, and wherein said carrying means has bends that are bent at upper and lower positions where the bends extend to the insertion plate and the fitting portion, while the insertion plate is slanted inward from the lower bend downward with an elongated aperture made therein so that the insertion plate has an elastic force.

2. A container bottle as claimed in claim 4, wherein said pair of holding pieces are formed to have the end opening at the end thereof of which width is smaller than the diameter of the ring-shaped groove, so that the holding pieces fit into the ring-shaped groove and hold onto the wall thereof when forced therein, or projections are formed to oppose each other on inner edges of the end opening that is formed to have the same width as the diameter of the ring-shaped groove so that the holding pieces fit into the ring-shaped groove and hold onto the wall thereof.

3. A container bottle comprising:

a plastic container bottle composed of a neck portion of thick wall, said neck portion having a step below a support ring of thick wall formed around a lower portion of said neck portion and projecting therefrom and having a ring-shaped groove between the step and the support ring, and a flat-shaped body portion of thin wall with shoulder portions extending to both sides from the base of the neck portion, that is formed integrally by stretch blow molding process; and carrying means composed of a rectangular insertion plate having a width at least substantially the same as the outer diameter of said neck portion, but smaller than a width of the body portion, and a fitting portion at an end thereof that is integrally formed from a flexible thermoplastic material in an L-shape, the fitting portion having a pair of holding pieces of the same shape with inner circumference thereof having the same diameter as the diameter of the ring-shaped groove and an end opening being narrower than the diameter of the ring-shaped groove, wherein said holding pieces are fitted onto the ring-shaped groove from the back face side of the body portion of the bottle, and said insertion plate is located with the longitudinal direction directed vertically at the center of the back face of the body portion, while a holding space is formed between said insertion plate and the back face side of the body portion, and wherein said insertion plate is bent at a lower position so that a free end thereof is directed outward and a bending portion is pressed against the back face of the body portion to make a strong contact therewith, while a reaction force thereto is concentrated at tips of the pair of holding pieces that form the fitting portion, thereby causing a rear end of the fitting portion to make strong contact with the bottom face of the support ring.

4. A container bottle as claimed in claim 3, wherein said bottle is composed of an elongated flat rectangular parallelepiped with said shoulder portions extending from the base of the neck portion to both sides in a substantially rectangular shape, with the surfaces on both sides being warped in the same direction, a convex side being used as a front face of the body portion and a concave side used as a back face of the body portion.

5. A container bottle as claimed in claim 3, wherein a plurality of reinforcing ribs are provided recessedly in an endless manner at equal intervals in the vertical direction around a lower portion of said bottle.

6. A container bottle as claimed in claim 3, wherein said pair of holding pieces are formed to have the end opening at the end thereof of which width is smaller than the diameter of the ring-shaped groove, so that the holding pieces fit into the ring-shaped groove and hold onto the wall thereof when forced therein, or projections are formed to oppose each other on inner edges of the end opening that is formed to have the same width as the diameter of the ring-shaped groove so that the holding pieces fit into the ring-shaped groove and hold onto the wall thereof.

7. A container bottle as claimed in claim 3, wherein projections of the pair of holding pieces are formed in a ratchet teeth configuration with inclined surfaces facing toward the opening, so that the projections fit in recesses that have corresponding shapes and are formed on both sides at the center of the ring-shaped groove to oppose each other, with inclined surfaces facing the front face of the body portion.

8. A container bottle comprising:

a plastic container bottle composed of a neck portion of thick wall, said neck portion having a step below a support ring of thick wall formed around a lower portion of said neck portion and projecting therefrom and having a ring-shaped groove between the step and the support ring, and a flat-shaped body portion of thin wall with shoulder portions extending to both sides from the base of the neck portion, that is formed integrally by stretch blow molding process; and carrying means composed of a rectangular insertion plate having a width at least substantially the same as the outer diameter of said neck portion, but smaller than a width of the body portion, and a fitting portion at an end thereof that is integrally formed from a flexible thermoplastic material in an L-shape, the fitting portion having a pair of holding pieces of the same shape with inner circumference thereof having the same diameter as the diameter of the ring-shaped groove and an end opening being narrower than the diameter of the ring-shaped groove, wherein said holding pieces are fitted onto the ring-shaped groove from the back face side of the body portion of the bottle, and said insertion plate is located with the longitudinal direction directed vertically at the center of the back face of the body portion, and wherein said carrying means has the fitting portion formed at the top end of a support plate, that makes contact with the back face of the body portion, being bent therefrom, and a bottle bottom receiving portion formed at the lower end thereof being bent in the same direction as the fitting portion, while an L-shaped insertion plate or a C-shaped belt passage plate is provided at an upper position of the support plate.

9. A container bottle as claimed in claim 8, wherein said pair of holding pieces are formed to have the end opening at the end thereof of which width is smaller than the diameter of the ring-shaped groove, so that the holding pieces fit into the ring-shaped groove and hold onto the wall thereof when forced therein, or projections are formed to oppose each other on inner edges of the end opening that is formed to have the same width as the diameter of the ring-shaped groove so that the holding pieces fit into the ring-shaped groove and hold onto the wall thereof.

10. A container bottle comprising:

a plastic container bottle composed of a neck portion of thick wall, said neck portion having a step below a support ring of thick wall formed around a lower portion of said neck portion and projecting therefrom and having a ring-shaped groove between the step and the support ring, and a flat-shaped body portion of thin wall with shoulder portions extending to both sides from the base of the neck portion, that is formed integrally by stretch blow molding process; and carrying means comprising a strap having such a length that makes substantially one turn around the bottle vertically at a position offset from said neck portion, connectors attached at both ends of the strap, a belt holding portion provided at a middle portion of the strap, a bottle shoulder holding portion provided between one of the connectors and the belt holding portion and a bottom receiving portion provided between the other connector and the belt holding portion, wherein the neck portion of the bottle is passed through an insertion hole formed in the bottle shoulder holding portion with the belt holding portion being located on the back face side of the body portion thereby causing the bottle shoulder holding portion to hold onto the bottle shoulder portion, and the bottle bottom receiving portion makes contact with a bottom portion of the bottle while the strap is connected endlessly by the connectors located on the front face of the body portion to hold onto the bottle vertically.

11. A container bottle as claimed in claim 10, wherein said strap is made of a fabric belt, a leather belt, or a plastic belt, and said connector is a plastic buckle or a surface fastener.

12. A container bottle comprising:

a plastic container bottle composed of a neck portion of thick wall, said neck portion having a step below a support ring of thick wall formed around a lower portion of said neck portion and projecting therefrom and having a ring-shaped groove between the step and the support ring, and a flat-shaped body portion of thin wall with shoulder portions extending to both sides from the base of the neck portion, that is formed integrally by stretch blow molding process; and carrying means composed of a rectangular insertion plate having a width at least substantially the same as the outer diameter of said neck portion and a fitting portion at an end thereof that is integrally formed from a flexible thermoplastic material in an L-shape, the fitting portion having a pair of holding pieces of the same shapes with inner circumference thereof having the same diameter as the diameter of the ring-shaped groove and an end opening being narrower than the diameter of the ring-shaped groove, wherein said holding pieces are fitted onto the ring-shaped groove from the back face side of the body portion of the bottle, and said insertion plate is located with the longitudinal direction directed vertically at the center of the back face of the body portion, while a holding space is formed between said insertion plate and the back face side of the body portion, and wherein the holding pieces have projections formed thereon, and the projections are formed in a ratchet teeth configuration with inclined surfaces facing toward the opening, so that the projections fit in recesses that have corresponding shapes and are formed on both sides at the center of the ring-shaped groove to oppose each other, with inclined surfaces facing the front face of the body portion.

* * * * *